US007183030B2

(12) United States Patent
Moudry et al.

(10) Patent No.: US 7,183,030 B2
(45) Date of Patent: Feb. 27, 2007

(54) NEGATIVELY CHARGED COATED ELECTROGRAPHIC TONER PARTICLES AND PROCESS

(75) Inventors: Ronald J. Moudry, Woodbury, MN (US); Julie Y. Qian, Woodbury, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 340 days.

(21) Appl. No.: 10/841,753

(22) Filed: May 7, 2004

(65) Prior Publication Data

US 2005/0250029 A1 Nov. 10, 2005

(51) Int. Cl.
*G03G 9/00* (2006.01)

(52) U.S. Cl. ..... 430/108.1; 430/114; 430/110.2; 430/137.1

(58) Field of Classification Search ..... 430/108.1, 430/110.2, 114, 137.1
See application file for complete search history.

(56) References Cited

U.S. PATENT DOCUMENTS

| | | | | |
|---|---|---|---|---|
| 3,411,936 | A | 11/1968 | Roteman et al. | 117/37 |
| 3,848,363 | A | 11/1974 | Lovness et al. | 51/7 |
| 3,892,908 | A | 7/1975 | Lovness | 428/329 |
| 4,013,807 | A | 3/1977 | Putney et al. | 427/184 |
| 4,024,295 | A | 5/1977 | Chase et al. | 427/47 |
| 4,071,304 | A | 1/1978 | Chauvin et al. | |
| 4,235,024 | A | 11/1980 | Chauvin et al. | |
| 4,268,598 | A | 5/1981 | Leseman et al. | 430/107 |
| 4,298,672 | A | 11/1981 | Lu | 430/108 |
| 4,321,404 | A | 3/1982 | Williams et al. | 560/115 |
| 4,413,048 | A | 11/1983 | Landa | 430/115 |
| 4,478,925 | A | 10/1984 | Miskinis | 430/137 |
| 4,560,635 | A | 12/1985 | Hoffend et al. | 430/106.6 |
| 4,656,112 | A | 4/1987 | Kawagishi et al. | 430/110 |
| 4,728,983 | A | 3/1988 | Zwadlo et al. | 355/4 |
| 4,741,918 | A | 5/1988 | Nagy de Nabybaczon et al. | 427/11 |
| 4,845,003 | A | 7/1989 | Kiriu et al. | 430/110 |
| 4,882,224 | A | 11/1989 | Moro et al. | 428/403 |
| 4,886,726 | A | 12/1989 | Chan et al. | 430/115 |
| 4,937,157 | A | 6/1990 | Haack et al. | 430/110 |
| 5,102,690 | A | 4/1992 | Iyer et al. | 427/57 |
| 5,167,989 | A | 12/1992 | Dudek et al. | 427/202 |
| 5,208,129 | A * | 5/1993 | Ciccarelli et al. | 430/108.2 |
| 5,215,785 | A | 6/1993 | Strasser et al. | 427/230 |
| 5,262,259 | A | 11/1993 | Chou et al. | 430/47 |
| 5,962,082 | A | 10/1999 | Hendrickson et al. | 427/547 |
| 6,037,019 | A | 3/2000 | Kooyer et al. | 427/598 |
| 6,197,369 | B1 | 3/2001 | Watano et al. | 427/213 |
| 6,200,643 | B1 | 3/2001 | Sugai et al. | 427/475 |
| 6,255,363 | B1 | 7/2001 | Baker et al. | 523/201 |
| 2004/0043141 | A1 | 3/2004 | Igarashi et al. | 427/157 |
| 2004/0091805 | A1 | 5/2004 | Qian et al. | 430/109.1 |
| 2004/0091806 | A1 | 5/2004 | Qian et al. | 430/109.31 |
| 2004/0091807 | A1 | 5/2004 | Qian et al. | 430/114 |
| 2004/0091808 | A1 | 5/2004 | Qian et al. | 430/114 |
| 2004/0091809 | A1 | 5/2004 | Qian et al. | 430/114 |

FOREIGN PATENT DOCUMENTS

| | | |
|---|---|---|
| EP | 1219354 A1 | 9/2000 |
| EP | 1394620 | 3/2004 |

OTHER PUBLICATIONS

Commonly assigned U.S. Appl. No. 10/841,753, filed May 7, 2004, entitled "Negatively Charged Coated Electrographic Toner Particles and Process" (SAM0032/US).
Commonly assigned U.S. Appl. No. 10/841,754, filed May 7, 2004, entitled "Process for Coating Particles" (SAM0033/US).
Commonly assigned U.S. Appl. No. 10/840,897, filed May 7, 2004, entitled "Positively Charged Coated Electrographic Toner Particles" (SAM0038/US).
Commonly assigned U.S. Appl. No. 10/841,876, filed May 7, 2004, entitled "Negatively Charged Coated Electrographic Toner Particles" (SAM0039/US).
"An introduction to powder modification technology," CSC Publishing, Powder and Bulk Engineering, Feb. 1990 (4 pgs).
"Mechano Fusion System," catalog pages from Hosokawa Micron International, Inc (8 pgs).
"Powder Surface Modification," Bulletin P-1, Process Equipment, bepex corporation (4 pgs).
European Search Report for EP 05252781 issued on Sep. 20, 2005.

* cited by examiner

*Primary Examiner*—Mark A. Chapman
(74) *Attorney, Agent, or Firm*—Kagan Binder, PLLC

(57) ABSTRACT

Negatively charged coated toner particles are provided that comprise a polymeric binder particle and a coating material. The coating material comprises at least one visual enhancement additive coated on the outside surface of the polymeric binder particle. Electrographic toner compositions comprising these particles, and methods of making these particles particularly by magnetically assisted impact coating processes are also provided.

28 Claims, No Drawings

NEGATIVELY CHARGED COATED ELECTROGRAPHIC TONER PARTICLES AND PROCESS

FIELD OF THE INVENTION

The invention relates to electrographic toners. More specifically, the invention relates to negatively charged toner particles having a coating comprising a visual enhancement additive.

BACKGROUND

Toner compositions are used in electrophotographic and electrostatic printing processes (collectively electrographic processes) to form an electrostatic image on the surface of a photoreceptive element or dielectric element, respectively. These toner compositions comprise a binder element, a visual enhancement additive, and often a charge control additive or charge director. In conventional toner manufacture processing, a polymeric binder is formed and homogeneously mixed with the visual enhancement additive and any other components.

In certain product technologies, particles are provided with separate coatings. Such coated particles are known, for example, in the catalyst, pharmaceutical and cosmetic industries.

U.S. Pat. No. 6,037,019 discloses a process for adhering a powder to a substrate. The process includes the steps of: a) providing an oscillating magnetic field, b) continuously introducing into the magnetic field coating material, a substrate, and a means of affixing the coating material to the substrate by forming a fluidized bed of at least the coating material and providing sufficient force to cause the coating material to adhere to the surface of the substrate, and c) continuously collecting the coated substrate.

A process for adhering a liquid to a particulate substrate is disclosed in U.S. Pat. No. 5,962,082. The process comprises the steps of: a) providing an apparatus which can create an oscillating magnetic field within a chamber, b) providing particulate magnetic material within the chamber of said apparatus while said oscillating field is active, c) having in the chamber within the oscillating magnetic field a liquid coating material and a particulate substrate to be coated with said liquid, d) and having said magnetic field form a fluidized bed of at least said particulate magnetic material, said liquid coating material coating the surface of the particulate substrate, and e) optionally continuously collecting the coated particulate substrate.

SUMMARY OF THE INVENTION

The present invention provides unique negatively charged coated toner particles comprising a polymeric binder particle and a coating material comprising at least one visual enhancement additive, wherein the coating material is coated on the outside surface of the polymeric binder particle. In one aspect of the present invention, the negatively charged toner particle is prepared by providing a blend of a coating material and polymeric binder particles, wherein the coating material comprises a visual enhancement additive and wherein the blend comprises magnetic elements. This blend is exposed to a magnetic field that varies in direction with time; whereby the movement of the magnetic elements in the magnetic field provides sufficient force to cause the coating material to adhere to the surface of the polymeric binder particle to form a negatively charged coated toner particle. Preferably, the blend of the coating material and polymeric binder particles is fluidized.

Toner particles as described herein have a unique configuration in that the visual enhancement additive is located on the surface of the toner particles. This configuration is markedly different from previous toner configurations, where the visual enhancement additives were homogenously mixed with the polymeric binder materials. This unique configuration provides significant benefits in providing a unique protective element whereby the polymeric binder component of the toner particle may be protected from adverse environmental conditions such as humidity, chemical sensitivity and light sensitivity, without addition of ingredients that do not contribute to (or that may even adversely effect) the functionality of the toner in its ultimate use. Further, such external coating of the polymeric binder may provide favorable anti-agglomeration functionality or other interaction functionality between the particles without the need to specifically add slip agents or other such materials. Location of the visual enhancement additive at the surface of the binder particle may provide better color saturation, thereby providing superior optical density without increasing the overall amount of visual enhancement additive in the toner particle as compared to prior art toners. Surprisingly, the location of the visual enhancement additive and optional other components at the surface of the binder particle does not adversely affect the adherence of the toner particle to the final substrate in imaging processes.

In one particularly preferred embodiment, substantially all of the visual enhancement additive is located at the surface of the toner particle.

In another particularly preferred embodiment, the toner particle of the present invention is prepared from a binder comprising at least one amphipathic graft copolymer comprising one or more S material portions and one or more D material portions. Such amphipathic graft copolymers provide particular benefit in unique geometry of the copolymer that may particularly facilitate coating of polymeric binder particles with coating materials. In a particularly preferred embodiment, the S portion of the amphipathic graft copolymer may have a relatively low $T_g$, while the D portion has a higher $T_g$ than the S portion. This embodiment provides a polymeric binder particle having a surface that is highly receptive to coating with a coating material, while the overall $T_g$ of the polymeric binder particle is not so low as to provide a toner particle that blocks or sticks together during storage or use.

Surprisingly, toner particles comprising binder particles having selected polymeric materials result in inherently generated negative toner particles. Advantageously, toner particles may be prepared from a binder particle comprising selected polymeric materials that result in inherently generated negative toner particles. It has been found that, in particular, likely classes of polymeric materials that result in inherently generated negative toner particles are randomly oriented polymers. It has additionally been discovered that binder particles made from selected amphipathic graft copolymers as described herein result in inherently generated positive toner particles. In an alternative embodiment, toner particles that do not result in inherently generated negative toner particles may be rendered negative by selection of components including charge directors or charge control additives that result in an overall negatively charged toner particle.

DETAILED DESCRIPTION

Negatively charged coated toner particles of the present invention preferably comprise sufficient visual enhancement additive in the coating to substantially cover the surface of the binder particle. More preferably, the particles comprise sufficient visual enhancement additive in the coating to completely cover the surface of the binder particle. The amount of coating material used depends on the desired properties sought by addition of the coating material and coating thickness. The weight ratio of binder particle to coating is preferably from about 100:1 to 1:20, more preferably 50:1 to 1:1, and most preferably 20:1 to 5:1.

Generally, the volume mean particle diameter ($D_v$) of the toner particles, determined by laser diffraction particle size measurement, preferably should be in the range of about 0.05 to about 50.0 microns, more preferably in the range of about 3 to about 10 microns, most preferably in the range of about 5 to about 7 microns. Preferably, the ratio of diameter of binder particle to the coating particle is greater than about 20.

Two types of toners are in widespread, commercial use: liquid toner and dry toner. The toner particles of the present invention may be used in either liquid or dry toner compositions for ultimate use in imaging processes. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

The negatively charged coated toner particles of the present invention comprise a polymeric binder particle and a coating material comprising at least one visual enhancement additive coated on the outside surface of the polymeric binder particle.

The binder of a toner composition fulfills functions both during and after electrographic processes. With respect to processability, the character of the binder impacts the triboelectric charging and charge retention characteristics, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers and the Fox equation expressed below:

$$1/T_g = w_1/T_{g1} + w_2/T_{g2} + \ldots w_i/T_{gi},$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54–55 (1992).

In the practice of the present invention, values of $T_g$ for the polymer of the binder or portions thereof (such as the D or S portion of the graft copolymer) may be determined using the Fox equation above, although the $T_g$ of the copolymer as a whole may be determined experimentally using e.g., differential scanning calorimetry. The glass transition temperatures ($T_g$'s) of the S and D portions may vary over a wide range and may be independently selected to enhance manufacturability and/or performance of the resulting toner particles. The $T_g$'s of the S and D portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

When used as part of a polymeric binder particle composition, various suitable toner resins may be selected for coating with the coating material as described herein. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyester resins, polyester resins, and mixtures thereof.

Such polymeric binder particles may be manufactured using a wide range of fabrication techniques. One widespread fabrication technique involves melt mixing the ingredients, comminuting the solid blend that results to form particles, and then classifying the resultant particles to remove fines and larger material of unwanted particle size.

Preferably, the polymeric binder particle comprises a graft amphipathic copolymer. The polymeric binder particles comprise a polymeric binder comprising at least one amphipathic copolymer with one or more S material portions and one or more D material portions.

As used herein, the term "amphipathic" refers to a copolymer having a combination of portions having distinct solubility and dispersibility characteristics in a desired liquid carrier that is used to make the copolymer. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier.

From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer." The core/shell structure of the binder particles tends to be retained when the particles are dried when incorporated into liquid toner particles.

Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

The materials of the polymeric binder particle are preferably selected to provide inherently negative toner particles. As a general principle, such polymers include styrene, styrene butyl acrylate, styrene butyl methacrylate and certain polyesters.

Alternatively, the polymers of the polymeric binder particle may be used that will inherently result in particles having a positive charge. As a general principle, many acrylate and methacrylate based polymers generate inherently positive toner particles. Preferred such polymers include polymers formed comprising one or more C1–C18 esters of acrylic acid or methacrylic acid monomers. Particular acrylates and methacrylates that are preferred for incorporation into amphipathic copolymers for binder particles include isononyl(meth)acrylate, isobornyl(meth)acrylate, 2-ethylhexyl(meth)acrylate, isobutyl(meth)acrylate, isodecyl(meth)acrylate, lauryl(dodecyl) (meth)acrylate, stearyl(octadecyl) (meth)acrylate, behenyl(meth)acrylate, n-butyl(meth)acrylate, methyl(meth)acrylate, ethyl(meth) acrylate, hexyl(meth)acrylate, isooctyl(meth)acrylate, combinations of these, and the like. When the overall tendency of the polymers used in the polymeric binder particle would result in a positive toner particle, negatively charged charge directors or charge control additives may be incorporated as described herein in a manner effective to impart an overall negative charge to the toner particle.

As noted above, the toner particles of the present invention may be used in either dry or liquid toner compositions. The selection of the polymeric binder material will in part be determined by the ultimate imaging process in which the toner particles are to be used. Polymeric binder materials suitable for use in dry toner particles typically have a high glass transition temperature ($T_g$) of at least about 50–65° C. in order to obtain good blocking resistance after fusing, yet typically require high fusing temperatures of about 200–250° C. in order to soften or melt the toner particles and thereby adequately fuse the toner to the final image receptor. High fusing temperatures are a disadvantage for dry toner because of the long warm-up time and higher energy consumption associated with high temperature fusing and because of the risk of fire associated with fusing toner to paper at temperatures approaching the autoignition temperature of paper (233° C.).

In addition, some dry toners using high $T_g$ polymeric binders are known to exhibit undesirable partial transfer (offset) of the toned image from the final image receptor to the fuser surface at temperatures above or below the optimal fusing temperature, requiring the use of low surface energy materials in the fuser surface or the application of fuser oils to prevent offset. Alternatively, various lubricants or waxes have been physically blended into the dry toner particles during fabrication to act as release or slip agents; however, because these waxes are not chemically bonded to the polymeric binder, they may adversely affect triboelectric charging of the toner particle or may migrate from the toner particle and contaminate the photoreceptor, an intermediate transfer element, the fuser element, or other surfaces critical to the electrophotographic process.

Polymeric binder materials suitable for use in liquid toner compositions may utilize a somewhat different selection of polymer components to achieve the desired $T_g$ and solubility properties. For example, the liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter of from about 0.1 to about 1 micron. Due to this relatively low Tg value, such particles are not generally not favored in the processes as described herein, because the storage and processing of such particles in the dry form present special handling issues to avoid blocking and sticking of the particles together. It is contemplated that special handling procedures may be utilized in this embodiment, such as maintenance of the ambient temperature of the particles when in the dry form below the temperature in which blocking or sticking takes place. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68–74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter of from about 3 to about 10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Preferred graft amphipathic copolymers for use in the binder particles are described in Qian et al, U.S. Ser. No. 10/612,243, filed on Jun. 30, 2003, entitled ORGANOSOL INCLUDING AMPHIPATHIC COPOLYMERIC BINDER AND USE OF THE ORGANOSOL TO MAKE DRY TONERS FOR ELECTROGRAPHIC APPLICATIONS and Qian et al., U.S. Ser. No. 10/612,535, filed on Jun. 30, 2003, entitled ORGANOSOL INCLUDING AMPHIPATHIC COPOLYMERIC BINDER HAVING CRYSTALLINE MATERIAL, AND USE OF THE ORGANOSOL TO MAKE DRY TONER FOR ELECTROGRAPHIC APPLICATIONS for dry toner compositions; and Qian et al., U.S. Ser. No. 10/612,534, filed on Jun. 30, 2003, entitled ORGANOSOL LIQUID TONER INCLUDING AMPHIPATHIC COPOLYMERIC BINDER HAVING CRYSTALLINE COMPONENT; Qian et al., U.S. Ser. No. 10/612,765, filed on Jun. 30, 2003, entitled ORGANOSOL INCLUDING HIGH Tg AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH Tg MONOMER AND LIQUID TONERS FOR ELECTROPHOTOGRAPHIC APPLICATIONS for liquid toner compositions, which are hereby incorporated by reference. Particularly preferred graft amphipathic copolymers for use in the binder particles comprise an S portion having a glass transition temperature calculated using the Fox equation (excluding grafting site components) of at least about 90° C., and more preferably from about 100° C. to about 130° C.

The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow 138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

The toner particles of the present invention may additionally comprise one or more additives as desired. Additional additives include, for example, UV stabilizers, mold inhibitors, bactericides, fungicides, antistatic agents, gloss modifying agents, other polymer or oligomer material, antioxidants, and the like.

These additives may be incorporated in the binder particle prior to coating, or may be incorporated in the coating material, or both. When the additives are incorporated in the binder particle prior to coating, the binder particle is combined with the desired additive and the resulting composition is then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated additive particles, when present, into primary particles (preferably having a diameter of from about 0.005 to about 5 microns, more preferably having a diameter of from about 0.05 to about 3 microns, and most preferably having a diameter of from about 0.1 to about 1 microns) and may also partially shred the binder into fragments that can associate with the additive. According to this embodiment, the copolymer or fragments derived from the copolymer then associate with the additives. Optionally, one or more visual enhancement agents may be incorporated within the binder particle, as well as coated on the outside of the binder particle.

Charge control agents are often used in dry toner when the other ingredients, by themselves, do not provide the desired triboelectric charging or charge retention properties.

One or more kinds of such charge control agents may be used. The amount of the charge control agent, based on 100 parts by weight of the toner solids, is generally 0.01 to 10 parts by weight, preferably 0.1 to 5 parts by weight.

Examples of negative charge control agents for the toner include organometal complexes and chelate compounds. Representative complexes include monoazo metal complexes, acetylacetone metal complexes, and metal complexes of aromatic hydroxycarboxylic acids and aromatic dicarboxylic acids. Additional negative charge control agents include aromatic hydroxyl carboxylic acids, aromatic mono- and poly-carboxylic acids, and their metal salts, anhydrides, esters, and phenolic derivatives such as bisphenol. Other negative charge control agents include zinc compounds as disclosed in U.S. Pat. No. 4,656,112 and aluminum compounds as disclosed in U.S. Pat. No. 4,845,003.

Examples of commercially available negatively charged charge control agents include zinc 3,5-di-tert-butyl salicylate compounds, such as BONTRON E-84, available from Orient Chemical Company of Japan; zinc salicylate compounds available as N-24 and N-24HD from esprix® technologies; aluminum 3,5-di-tert-butyl salicylate compounds, such as BONTRON E-88, available from Orient Chemical Company of Japan; aluminum salicylate compounds available as N-23 from esprix® technologies; calcium salicylate compounds available as N-25 from esprix® technologies; zirconium salicylate compounds available as N-28 from esprix® technologies; boron salicylate compounds available as N-29 from esprix® technologies; boron acetyl compounds available as N-31 from esprix® technologies; calixarenes, such as such as BONTRON E-89, available from Orient Chemical Company of Japan; azo-metal complex Cr (III) such as BONTRON S-34, available from Orient Chemical Company of Japan; chrome azo complexes available as N-32A, N-32B and N-32C from esprix® technologies; chromium compounds available as N-22 from esprix® technologies and PRO-TONER CCA 7 from Avecia Limited; modified inorganic polymeric compounds such as Copy Charge N4P from Clariant; and iron axo complexes available as N-33 from esprix® technologies.

Preferably, the negative charge control agent is colorless, so that the charge control agent does not interfere with the presentation of the desired color of the toner. In another embodiment, the charge control agent exhibits a color that can act as an adjunct to a separately provided the colorant, such as a pigment. Alternatively, the charge control agent may be the sole colorant in the toner. In yet another alternative, a pigment may be treated in a manner to provide the pigment with a negative charge.

Examples of negative charge control agents having a color or negatively charged pigments include Copy Charge NY VP 2351, an Al-azo complex from Clariant; Hostacoply N4P-N101 VP 2624 and Hostacoply N4P-N203 VP 2655, which are modified inorganic polymeric compounds from Clariant.

When the ultimate toner composition is to be a liquid toner, one or more charge directors can be added before or after this mixing process, if desired. Charge directors, may be used in any liquid toner process, and particularly may be used for electrostatic transfer of toner particles or transfer assist materials. The charge director typically provides the desired uniform charge polarity of the toner particles. In other words, the charge director acts to impart an electrical charge of selected polarity onto the toner particles as dispersed in the carrier liquid. Preferably, the charge director is coated on the outside of the binder particle. Alternatively or additionally, the charge director may be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

Any number of charge directors such as those described in the art may be used in the liquid toners or transfer assist materials of the present invention in order to impart a negative electrical charge onto the toner particles. For example, the charge director may be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt(e.g., Na) of a phosphoglyceride A preferred example of such a charge director is Emphos™ D70–30C, Witco Chemical Corp., New York. N.Y., which is a sodium salt of phosphated mono- and diglycerides.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive may be adjusted based on a variety of parameters to achieve the desired results for a particular application.

After preparation of the polymeric binder particles, the particles are prepared for coating. In the preferred coating process of the present invention, the binder particles are dried for coating. The manner in which the dispersion is dried may impact the degree to which the resultant toner particles may be agglomerated and/or aggregated. In preferred embodiments, the particles are dried while fluidized, aspirated, suspended, or entrained (collectively "fluidized") in a carrier gas to minimize aggregation and/or agglomeration of the dry toner particles as the particles dry. In practical effect, the fluidized particles are dried while in a low density condition. This minimizes interparticle collisions, allowing particles to dry in relative isolation from other particles. Such fluidizing may be achieved using vibration energy, electrostatic energy, a moving gas, combinations of these, and the like. The carrier gas may comprise one or more gases that may be generally inert (e.g. nitrogen, air, carbon dioxide, argon, or the like). Alternatively, the carrier gas may include one or more reactive species. For instance, an oxidizing and/or reducing species may be used if desired. Advantageously, the product of fluidized drying constitutes free flowing dry toner particles with a narrow particle size distribution.

As one example of using a fluidized bed dryer, the liquid toners may be filtered or centrifuged to form a wet cake. The wet filter cake may be placed into the conical drying chamber of a fluid bed dryer (such as that available from Niro Aeromatic, Niro Corp., Hudson, Wis.). Ambient air at about 35–50° C., or preferably lower than the $T_g$ of the copolymer, may be passed through the chamber (from bottom to top) with a flow rate sufficient to loft any dried powder and to keep the powder airborne inside the vessel (i.e., a fluidized powder bed). The air may be heated or otherwise pretreated. Bag filters in the vessel allow the air to leave the drying vessel while keeping the powder contained.

Any toner that accumulates on the filter bags may be blown down by a periodic reverse air flow through the filters. Samples may be dried anywhere from 10–20 minutes to several hours, depending on the nature of the solvent (e.g. boiling point), the initial solvent content, and the drying conditions.

As noted above, unique negatively charged toner particles may be prepared by a magnetically assisted coating (MAIC) process as described herein. Alternatively, other coating processes capable of providing negatively charged coated toner particles that are coated on the outside surface of the polymeric binder particle by a coating material comprising at least one visual enhancement additive may be used. For example, coating processes such as spray coating, solvent evaporation coating or other such processes capable of providing a layer as described herein may be utilized as will now be appreciated by the skilled artisan.

In the preferred magnetically assisted coating process, a blend of a coating material and polymeric binder particles is provided, wherein the blend comprises magnetic elements. This blend is exposed to a magnetic field that varies in direction with time; whereby the movement of the magnetic elements in the magnetic field provides sufficient force to cause the coating material to adhere to the surface of the polymeric binder particle to form a negatively charged coated toner particle.

Preferably, the magnetic field is an oscillating magnetic field. Such an oscillating magnetic field may be supplied, for example, with power by means of oscillators, oscillator/amplifier combinations, solid-state pulsating devices and motor generators. The magnetic field may also be provided by means of air core or laminated metal cores, stator devices or the like. The preferred magnetic field generator is provided by one or more motor stators, i.e., motors having the armatures removed, which are powered by an alternating current supply through transformers. In addition, metal strips may be placed outside the magnetic field generators to confine the magnetic fields to a specific volume of space.

A useful magnetic field is one with an intensity sufficient to cause desirable movement, but not enough to demagnetize the magnetic character of coating materials or magnetic elements that are moved by the oscillating magnetic fields. Preferably the magnetic fields have between about 100 Oersteds and 3000 Oersteds magnetic intensity, more preferably between about 200 and 2500 Oersteds magnetic intensity.

The frequency of oscillations in the oscillating magnetic field affects the number of collisions that take place between an element that is moved in the magnetic field and surrounding particles that are preferably fluidized (i.e., always kept in motion) by collisions with the moving magnetic elements or the coating material when it is magnetic in character. Preferably the oscillations of the magnetic field are in a steady, uninterrupted rhythm. Alternatively, the oscillations of the magnetic field may be in an irregular frequency and/or magnitude. Optionally, additional mechanisms and systems may be utilized to assist in fluidization of the particles, such as the use of air flow as will now be appreciated by the skilled artisan. If the oscillation frequency is too high, the magnetic elements or the coating material when it is magnetic in character are unable to spin in the changing field due to the inertia of the elements. If the oscillation frequency is too low, residence time is increased until there is not enough movement in the magnetic elements or the coating material when it is magnetic in character to fluidize the particles. The oscillation in the magnetic field can be caused, for example, by using multiphase stators to create a rotating magnetic field, as disclosed in U.S. Pat. Nos. 3,848,363; 3,892,908; or 4,024,295; the disclosures of which are incorporated herein by reference, or by using a single phase magnetic field generator with an AC power supply at a specified cycles per second to create a bipolar oscillating magnetic field. The frequency may be from 5 hertz to 1,000,000 hertz, preferably from 50 hertz to 1000 hertz, and more preferably at the hertz that is commonly used in AC power supplies, i.e., 50 hertz, 60 hertz, and 400 hertz. The bipolar magnetic field is preferred as the magnetic field generators used are generally less expensive and more available than those used to make rotating magnetic fields.

In a preferred aspect of the present invention, the coating material is provided as a dry material. Coating materials, when in particulate form, can be of any of a wide variety of shapes such as, for example, spherical, flake, and irregular shapes.

The binder particle may be in the form of loose agglomerates when agglomerates are easily broken up by collisions in the magnetic field. However, the friability of the binder particle may vary over a broad range and is limited only that the binder particle should be durable enough to permit interaction of the individual particles under in the presence of numerous collisions from magnetic elements, without breakage of the primary binder particles.

The coating material is applied onto the binder particle by the action of the coating material or binder particle if magnetic in character or by the action of additional magnetic elements (discussed below) in a varying magnetic field which causes peening of the coating materials onto the binder particle. When neither the coating material nor the particulate binder particle is magnetic, the varying magnetic field causes impingement of the magnetic elements into the coating material which forces the material onto the binder particle with a peening action.

Alternatively, the coating material may be provided in liquid form. In this embodiment, the liquid may be introduced into the composition either independently of the particulate binder particle to be coated (e.g., added before, after or during initiation of the movement of the magnetic particles, before, with or after any introduction of any non-magnetic particles to be coated, by spray, injection, dripping, carriage on other particles, and any other method of providing liquid into the chamber so that it may be contacted by moving particles and distributed throughout the coating chamber) or added with particulate materials (e.g., the particles, either magnetic or non-magnetic, may be pretreated or pre-coated with liquid and the particle movement process initiated or coated, or the liquid may be added simultaneously through the same or different inlet means). Pre-treated (pre-coated) magnetic particles may be provided before or during movement of the particles. Non-magnetic particles may be added before or during movement of the particles. All that needs to be done to accomplish liquid coating of particles within the bed is to assure that at some time during particle movement, both the liquid to be coated and the particles which are desired to be coated are present within the system. The physical forces operating within the system will assure that the liquid is evenly spread over the particles if the particles and liquid are allowed to remain in the system for a reasonable time. The time during which the system equilibrates may range from a few seconds to minutes, partially dependent upon the viscosity of the liquid. The higher the viscosity of the liquid, the more time it takes for the liquid to be spread over the particles surfaces. This time factor can be readily determined by routine experimentation and can be estimated and correlated from the viscosity, particle sizes, relative wetting ability of the liquid for the particle surface and other readily observable characteristics of the system.

Optionally, adhesion of the visual enhancement additive and/or other materials in the coating to the binder particle is enhanced through the use of processing conditions or chemical bonding techniques. For example the coating process may be carried out at somewhat elevated temperature so that the surface of the binder particle will become at least partially tacky, thereby enhancing adhesion of the coating material to the binder particle by adhesive properties. In this embodiment, the process temperature is carefully balanced with concentration of both the binder particles and the coating material, as well as other factors (for example, the $T_g$ of the polymer, and particularly of the S portion when the polymer is an amphipathic graft copolymer), to minimize undesirable agglomeration of binder particles during the particle coating process. Preferably, the coating process is carried out at an environmental temperature in the vessel in which the coating process takes place that is from about 10° C. to about 35° C. below the $T_g$ of the polymeric binder particle. In a preferred embodiment, the polymeric binder particle is a graft copolymer having S and D portions, and the environmental temperature in the vessel is from about 10° C. to about 35° C. below the $T_g$ of the S portion of the polymeric binder particle.

In another embodiment of enhancement of adhesion of the visual enhancement additive and/or other materials in the coating to the binder particle, the chemical affinity of one or more materials in the coating composition to the binder particle is enhanced by use of a bridging chemical, such as an adhesive, or by the incorporation of chemical functionalities on both the material of the coating and the binder particle that will form covalent bonds or exhibit an affinity to provide enhanced adhesion of one or more coating materials to the binder particle.

Enhanced adhesion of the coating to the polymer binder particle is particularly desirable in both dry and liquid toner environments. In dry toner compositions, transport of the toner may cause slight collisions leading to adhesion failure. Likewise, in liquid toner compositions, poor adhesion of the coating may result in undesired dissociation of the coating from the polymeric binder particle during storage or use. In either environment, inadequate adhesion of the coating material to the binder particle may result in fines that cause development problems, such as wrong sign toner issues.

In a preferred embodiment, the coating process is a continuous process. In such a process, a certain amount of the coating material coats the magnetic elements and the reaction chamber until a state of equilibrium is reached. Once a state of equilibrium is reached, this is maintained while the continuous coating process progresses. This is an improvement over the time consuming batch process that may or may not have time to reach a state of equilibrium and hence not give consistently uniform coatings.

Where the coating material has magnetic character such as with a magnetic powder, the powder generally has a coercivity ranging from about 200 to 5000 Oersteds.

The magnetic elements as discussed above are individual minute permanent magnets that can be used to cause collisions between the coating material and the binder particle. Such magnetic elements generally have coercivities also ranging from 200 to 3000 Oersteds. Suitable magnetic elements include, for example, gamma iron oxide, hard barium ferrite, particulate aluminum-nickel-cobalt alloys, or mixtures thereof. Magnetic elements can also comprise magnetic powder embedded in a polymeric matrix, such as barium ferrite embedded in sulfur cured nitrile rubber such as ground pieces of PLASTIFORM™ Bonded Magnets, available from Arnold Engineering Co., Norfolk, Nebr. In addition, the magnetic elements can be coated with polymeric materials, such as, for example, cured epoxy or polytetrafluoroethylene, to smooth the surface of the magnetic elements or make them more wear resistant. This particular advantage is evident when coating with a white powder coating material, because the resultant coating remains white and is not discolored and/or blackened in the process.

Magnetic elements can range in size from less than the size of the powder of the coating material being applied to over 1000 times the size of the binder particle being coated. If the magnet elements are too small, they can be difficult to separate from a coated binder particle. Generally, the magnetic elements range in size from 0.005 μm to 1 cm. Strips of polymer embedded magnetic materials, with a length many times the size of a binder particle, are also sometimes useful for fluidizing sticky particulate polymeric binder particles. In general, magnetic strips have a particle size of from about 0.05 mm to 500 mm, more preferably from about 0.2 mm to 100 mm, and most preferably from 1.0 mm to 25 mm. The appropriate size of the magnetic elements can be readily determined by those skilled in the art.

The quantity of magnetic elements that can be used in a magnetic field depends on residence time, type of coating, and ability of the moving magnetic elements to cause collisions between the coating material and the binder particles. Preferably, only that quantity of magnetic elements needed to cause these collisions, and preferably to fluidize the blend, is used. In general, the weight of the magnetic elements should be approximately equal to the weight of the blend in the magnetic field at a given time.

Chambers useful in the present invention can be of a variety of non-metallic materials such as flint glass; tempered glass, e.g., PYREX™ glass; synthetic organic plastic materials such as polytetrafluoroethylene, polyethylene, polypropylene, polycarbonate and nylon; and ceramic materials. Metallic materials can be used although eddy currents can occur, which would negatively affect the oscillating magnetic field and increased power would be required to overcome these effects.

The thickness of the chamber wall should be sufficient to withstand the collisions of the magnetic elements and depends on the materials used. Appropriate thickness can readily be determined by those skilled in the art. When polycarbonate is used to form the chamber, a suitable wall thickness can be from 0.1 mm to 25 mm, preferably from 1 mm to 5 mm, more preferably from 1 mm to 3 mm.

The shape of the chamber can be cylindrical, spherical, polyhedral or irregular since the magnetic field will fill any shape and preferably to fluidize the powder within the chamber. The chamber can be of any orientation, such as, for example, vertical, horizontal, angular, or corkscrew. A preferred chamber configuration is disclosed in U.S. Pat. Nos. 6,037,019 and 5,962,082, the disclosures of which are expressly incorporated herein by reference.

After coating of the binder particle with the coating composition comprising visual enhancement additive, the resulting toner particle may optionally be further processed by additional coating processes or surface treatment such as spheroidizing, flame treating, and flash lamp treating.

The toner particles may then be provided as a toner composition, ready for use, or blended with additional components to form a toner composition.

Optionally, the toner particles provided as a liquid toner composition by suspending or dispersing the toner particles in a liquid carrier. The liquid carrier is typically nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

The liquid carrier of the liquid toner composition is preferably a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

Exemplary characteristics of the overall composition to make preferred dry toners of the present invention are described, for example, in Qian et al. applications: U.S. Ser. No. 10/612,243, filed on Jun. 30, 2003 and U.S. Ser. No. 10/612,535, filed on Jun. 30, 2003.

Exemplary characteristics of the overall composition to make preferred liquid toners of the present invention are described, for example, in Qian et al. applications: U.S. Ser. No. 10/612,534, filed on Jun. 30, 2003; U.S. Ser. No. 10/612,765, filed on Jun. 30, 2003; and U.S. Ser. No. 10/612,533, filed on Jun. 30, 2003.

Toners of the present invention are in a preferred embodiment used to form images in electrographic processes, including electrophotographic and electrostatic processes.

In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, and cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively discharging the charged surface of the photoreceptor in an imagewise manner corresponding to the desired image to be formed on the final image receptor. In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

The invention will further be described by reference to the following nonlimiting examples.

EXAMPLES

Test Methods and Apparatus

In the following toner composition examples, percent solids of the graft stabilizer solutions and the organosol and liquid toner dispersions were determined thermo-gravimetrically by drying in an aluminum weighing pan an originally-weighed sample at 160° C. for four hours, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using tetrahydrofuran as the carrier solvent. Absolute weight average molecular weight were determined using a Dawn DSP-F light scattering detector (Wyatt Technology Corp., Santa Barbara, Calif.), while polydispersity was evaluated by ratioing the measured weight average molecular weight to a value of number average molecular weight determined with an Optilab 903 differential refractometer detector (Wyatt Technology Corp., Santa Barbara, Calif.).

Organosol and liquid toner particle size distributions were determined by the Laser Diffraction Light Scattering Method using a Horiba LA-900 or LA-920 laser diffraction particle size analyzer (Horiba Instruments, Inc., Irvine, Calif.). Liquid samples were diluted approximately 1/10 by volume in Norpar™ 12 and sonicated for one minute at 150 watts and 20 kHz prior to measurement in the particle size analyzer according to the manufacturer's instructions. Dry toner particle samples were dispersed in water with 1% Triton X-100 surfactant added as a wetting agent. Particle size was expressed as both a number mean diameter ($D_n$) and a volume mean diameter ($D_v$) and in order to provide an indication of both the fundamental (primary) particle size and the presence of aggregates or agglomerates.

One important characteristic of xerographic toners is the toner's electrostatic charging performance (or specific charge), given in units of Coulombs per gram. The specific charge of each toner was established in the examples below using a blow-off tribo-tester instrument (Toshiba Model TB200, Toshiba Chemical Co., Tokyo, Japan). To use this device, the toner is first electrostatically charged by combining it with a carrier powder. The latter usually is a ferrite powder coated with a polymeric shell. The toner and the coated carrier particles are brought together to form the developer. When the developer is gently agitated, tribo-charging results in both of the component powders acquiring an equal and opposite electrostatic charge, the magnitude of which is determined by the properties of the toner, along with any compounds deliberately added to the toner to affect the charging (e.g., charge control agents).

Once charged, the developer mixture is placed in a small holder inside the blow-off tribo-tester. The holder acts a charge-measuring Faraday cup, attached to a sensitive capacitance meter. The cup has a connection to a compressed nitrogen line and a fine screen at its base, sized to retain the larger carrier particles while allowing the smaller toner particles to pass. When the gas line is pressurized, gas flows thought the cup and forces the toner particles out of the cup through the fine screen. The carrier particles remain in the Faraday cup. The capacitance meter in the tester measures the charge of the carrier; the charge on the toner that was removed is equal in magnitude and opposite in sign. A measurement of the amount of toner mass lost yields the toner specific charge, in microCoulombs per gram.

For the present measurements, a silicon coated ferrite carrier (Vertex Image Systems Type 2) with a mean particle size of about 80–100 microns was used. Toner was added to the carrier powder to obtain a 3 weight percent toner content in the developer. This developer was gently agitated on a roller table for at least 45 minutes before blow-off testing. Specific charge measurements were repeated at least five times for each toner to obtain a mean value and a standard deviation. Tests were considered valid if the amount of toner mass lost during the blow-off was between 50 and 100% of the total toner content expected in each sample. Tests with mass losses outside of these values were rejected.

Thermal transition data for synthesized toner material was collected using a TA Instruments Model 2929 Differential Scanning Calorimeter (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5–10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value-values are reported from either the third or fourth heat ramp.

Materials

The following abbreviations are used in the examples:

St: styrene (available from Aldrich Chemical Co., Milwaukee, Wis.)

BHA: behenyl acrylate (a PCC available from Ciba Specialty Chemical Co., Suffolk, Va.)

BMA: butyl methacrylate (available from Aldrich Chemical Co., Milwaukee, Wis.)

AIBN: azobisisobutyronitrile (an initiator available as VAZO-64 from DuPont Chemical Co., Wilmington, Del.)

PVP: polyvinylpyrrolidone (International Specialty Products, Wayne, N.J.)

P(St-BMA): copolymer of styrene and butyl methacrylate

P(St-BHA): copolymer of styrene and behenyl acrylate

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) is designated TCHMA/HEMA-TMI (97/3-4.7), and is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97-3-4.7//100) is made by copolymerizing the designated graft stabilizer (TCHMA/HEMA-TMI (97/3-4.7)) (S portion or shell) with the designated core monomer EMA (D portion or core) at a specified ratio of D/S (core/shell) determined by the relative weights reported in the examples.

1. Organosol Particle Preparation

Example 1

An 32 ounce (0.72 liter), narrow-mouthed glass bottle was charged with 122.6 g of DDI (distilled and de-ionized) water, 490.6 g of ethyl alcohol, 39.2 g of St, 30.8 g of BMA, 14 g of PVP K-30 (International Specialty Products, Wayne, NJ), and 2.8 g of AIBN. The bottle was purged for 1 minute with dry nitrogen at a rate of approximately 1.5 liters/min, and then sealed with a screw cap fitted with a Teflon liner. The cap was secured in place using electrical tape. The sealed bottle was then inserted into a metal cage assembly and installed on the agitator assembly of an Atlas Launder-Ometer (Atlas Electric Devices Company, Chicago, Ill.). The Launder-Ometer was operated at its fixed agitation speed of 42 rpm with a water bath temperature of 70° C. The mixture was allowed to react for approximately 16–18 hours at which time the conversion of monomer to polymer was quantitative. The mixture was then cooled to room temperature, yielding an opaque dispersion.

The particle size of P(St-BMA) was determined using a Horiba LA-900 laser diffraction particle size analyzer. (Horiba Instruments, Inc., Irvine, Calif.), as described above. The dispersed pigments had a volume mean particle diameter of 4.7 μm.

The particles were allowed to settle down and the mixture of ethyl alcohol and water was removed, and the concentration was tray-dried at room temperature under a hood with high air circulation. The particles size of dried P(St-BMA) was determined using a Horiba LA-900 laser diffraction particle size analyzer (Horiba Instruments, Inc., Irvine, Calif.), as described above. The dispersed pigments had a volume mean particle diameter of 6.5 μm. The glass transition temperature was measured using DSC, as described above. The P(St-BMA) particles had a $T_g$ of 56° C.

Example 2

Using the method and apparatus of Example 1, 613.2 g of ethyl alcohol, 56 g of St, 14 g of BHA, 14 g of PVP K-30, 2.8 g of AIBN were combined and resulting mixture reacted at 70° C. for 16 hours. The mixture was then cooled to room temperature, yielding an opaque dispersion.

The particle size of P(St-BHA) was determined using a Horiba LA-900 laser diffraction particle size analyzer (Horiba Instruments, Inc., Irvine, Calif.), as described above. The dispersed pigments had a volume mean particle diameter of 7.2 μm.

The particles were allowed to settle down and the ethyl alcohol was removed, and the concentration was tray-dried at room temperature under a hood with high air circulation. The particles size of dried P(St-BHA) was determined using a Horiba LA-900 laser diffraction particle size analyzer (Horiba Instruments, Inc., Irvine, Calif.), as described above. The dispersed pigments had a volume mean particle diameter of 8.6 μm. The glass transition temperature was measured using DSC, as described above. The P(St-BHA) particles had a $T_g$ of 65° C.

2. Dry Toner by MAIC Coating of Pigment onto Polymer Particle

Example 3

The dried polymer particles obtained from example 1 were combined with carbon black (Black Pearls L, Cabot Corporation, Billerica, Mass.) at a total carbon black content of 14.3% (to form Toner ID 1) or 10% (to form Toner ID 2). A negative charge control agent (Copy Charge N4P, Clariant, Coventry, R.I.) was added at 1 wt %. The powder mixing was done with a 4L twin shell ("V") blender. Each polymer/pigment/CCA was passed through the MAIC using an open column.

The premixed powder (organosol/pigment/charge control agent) was placed in a closed container along with about 50 g of small permanent magnets. The jar was exposed to the alternating field of the MAIC to set up a fluidized bed of small magnets.

3. Evaluation of Toner Particles

1) Q/M by Blow-off Tester

The MAIC coated samples obtained from example 3 were mixed with a carrier powder (Vertex Image Systems, Type2). After low speed mixing for at least 45 minutes, the toner/carrier was analyzed with a Toshiba Blow-off tester to obtain the specific charge (in microCoulombs/gram) of each toner. At least three such measurements were made, yielding a mean value and a standard deviation. The data was monitored for quality, namely, mass loss was observed to fall within 70–100% of total toner content of each blow off sample. Toners of known charging properties were also run as test calibration standards.

2) Toner Particle Size

The MAIC coated samples obtained from example 3 were dispersed in Norpar™ 12 which contain 1% Aerosol OT (dioctyl sodium sulfosuccinate, sodium salt, Fisher Scientific, Fairlawn, N.J.). The toner particle size was measured using a Horiba LA-900 laser diffraction particle size analyzer, as described above.

TABLE 1

Dry Toner By MAIC

| Toner ID | Carbon Black (wt %) | $D_v$ (μm) | Q/M (μC/g) Mean | Q/M (μC/g) SD |
|---|---|---|---|---|
| 1 | 14.3 | 11.7 | −101.8 | 7.43 |
| 2 | 10 | 17.4 | −57.9 | 4.87 |

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

The invention claimed is:

1. Negatively charged coated toner particles comprising a) a plurality of polymeric binder particle and b) a coating material comprising at least one visual enhancement additive coated on the outside surface of the polymeric binder particles.

2. The negatively charged coated toner particles of claim 1, wherein the coating material comprises at least one charge control agent or charge director.

3. The negatively charged coated toner particles of claim 1, wherein the coating material comprises at least one flow agent.

4. The negatively charged coated toner particles of claim 1, wherein the polymeric binder particles are formed from random polymers.

5. The negatively charged coated toner particles of claim 1, wherein the polymeric binder particles are formed from a polymeric binder comprising at least one amphipathic graft copolymer comprising one or more S material portions and one or more D material portions.

6. The negatively charged coated toner particles of claim 1, wherein the weight ratio of binder particle to coating is 50:1 to 1:1.

7. The negatively charged coated toner particles of claim 1, wherein the weight ratio of binder particle to coating is 20:1 to 5:1.

8. The negatively charged coated toner particles of claim 1, wherein the coating material is magnetic.

9. The negatively charged coated toner particles of claim 1, wherein the polymeric binder particle is magnetic.

10. A dry negative electrographic toner composition comprising a plurality of negatively charged toner particles of claim 1.

11. The dry negative toner composition of claim 10, wherein the composition comprises magnetic material.

12. A liquid negative liquid electrographic toner composition comprising:

a) a liquid carrier having a Kauri-Butanol number less than about 30 mL;

b) a plurality of negatively charged toner particles of claim 1 dispersed in the liquid carrier.

13. The liquid negative toner composition of claim 12, wherein the composition comprises magnetic material.

14. A process for adhering a visual enhancement additive to a polymeric binder particle, comprising the steps of:

a) providing a blend of a coating material and polymeric binder particles, wherein the coating material comprises a visual enhancement additive and wherein the blend comprises magnetic elements; and b) exposing the blend to a magnetic field that varies in direction with time; whereby the movement of the magnetic elements in the magnetic field provides sufficient force to cause the coating material to adhere to the surface of the polymeric binder particle to form a negatively charged coated toner particle.

15. The process of claim 14, wherein the magnetic field is an oscillating magnetic field.

16. The process of claim 15, wherein the oscillating magnetic field is a bipolar oscillating field.

17. The process of claim 15, wherein the oscillations of the magnetic field are in a steady, uninterrupted rhythm.

18. The process of claim 14, wherein the blend of a coating material and polymeric binder particles of step (b) is fluidized.

19. The process of claim 14, wherein the polymeric binder particles are magnetic elements.

20. The process of claim 14, wherein the coating material comprises magnetic elements.

21. The process of claim 14, wherein the magnetic elements are particles that are separate from the coating material and the polymeric binder particles.

22. The process of claim 14, wherein the coating material is in the form of a dry particle.

23. The process of claim 14, wherein the coating material is in the form of a liquid.

24. The process of claim 14, wherein the coating material comprises at least one charge control agent.

25. The process of claim 14, wherein the coating material comprises at least one flow agent.

26. The process of claim 14, wherein the polymeric binder particles are formed from random polymers.

27. The process of claim 14, wherein the polymeric binder particles are formed from a polymeric binder comprising at least one amphipathic graft copolymer comprising one or more S material portions and one or more D material portions.

28. The product made by the process of claim 14.

* * * * *